United States Patent [19]

Tucker et al.

[11] 3,936,234

[45] Feb. 3, 1976

[54] DEVICE FOR LOCKING TURBOMACHINERY BLADES

[75] Inventors: James W. Tucker; Robert O. Bobinger, both of Cincinnati, Ohio

[73] Assignee: General Electric Company, Cincinnati, Ohio

[22] Filed: Feb. 10, 1975

[21] Appl. No.: 548,678

[52] U.S. Cl. ..... 416/220 R; 416/221

[51] Int. Cl.² ..... F01D 5/32

[58] Field of Search ..... 416/220, 221

[56] References Cited

UNITED STATES PATENTS

| | | | |
|---|---|---|---|
| 2,971,743 | 2/1961 | Welsh | 416/191 |
| 3,076,634 | 2/1963 | Boyle et al. | 416/221 |
| 3,383,095 | 5/1968 | Anderson | 416/220 |
| 3,395,891 | 8/1968 | Burge et al. | 416/220 |
| 3,572,970 | 3/1971 | Smuland | 416/221 |
| 3,632,228 | 1/1972 | Acres | 416/220 |
| 3,832,092 | 8/1974 | Manharth | 416/220 |

*Primary Examiner*—Everette A. Powell, Jr.
*Attorney, Agent, or Firm*—Henry J. Policinski; Derek P. Lawrence

[57] ABSTRACT

A blade locking device, for locking radially projecting blades on a rotor includes a pair of retaining pins having enlarged forward and aft end portions or lugs. The retaining pins are inserted into a radial space between the blade tang and the bottom of the rotor slot. Spacer means maintain the retaining pins circumferentially spaced apart and further maintain the end lugs in confronting and overlapping relationship with forward and aft abutment surfaces on the sides of the rotor and with forward and aft end faces on each end of the blade tang. The spacer means are fixed against axial movement relative to said retaining members. Resilient biasing means can be provided to bias the rotor blade radially outward.

12 Claims, 11 Drawing Figures

2
3
A
10
11
12
13
14
15
16
17
18
19
20
22
23
24
25
26
27
28
30
32
34
36
37
38
39
41
42
43
44
45
46
48
50
52
54
56

DEVICE FOR LOCKING TURBOMACHINERY BLADES

BACKGROUND OF THE INVENTION

The present invention relates to turbomachines and, more particularly, to improved means for locking rotor blades in rotor slots.

In the manufacture of bladed turbomachinery rotors, retention of the blades on a rotor, such as a turbine or fan rotor, has been commonly accomplished by insertion of metal strips within the rotor slot and subsequent bending of the ends of the metal strip such that the ends overlap the base of the blade and the radially extending faces of the rotor. These retainers have exhibited features which have proven to be undesirable. An example of one such undesirable feature is that loads tending to displace the rotor blade from its slot are absorbed by the bent ends of the metal strip. Since the metal strips have generally been designed to easily accommodate bending upon installation they are susceptible to bending in an opposite direction due to forces applied by the rotor blade.

Other undesirable features are associated with servicing of the rotor blade. Removal of the prior art devices during routine maintenance has proven troublesome since access, which in many instances cannot be conveniently provided, is required at both sides of the rotor disc. Furthermore, the prior art devices as described above are not suitable for re-use because of alterations in the physical and metallurgical properties associated with repeated bending of the ends of the retainers upon removal and re-installation of the blades. The attendant replacement of the retainers is costly, especially if a substantial number of blades must be removed for servicing.

Other prior art devices such as that shown in U.S. Pat. No. 3,832,092 have served generally to advance the state of the art in blade locking devices. However, such a device does not provide for load bearing members which fill available slot width to a maximum degree. Rather, since such members are rotated into the locking position, the cross-sectional area of such members are constrained by the height of the space between the rotor blade tang and bottom of the slot. Furthermore, these devices, while locking the blade generally within the rotor slot, do not provide means for preventing slight radial and angular movement of the blade within the slot. Such movement can result from machining the blade tang, rotor slot and locking device to within certain tolerances rather than to specific dimensions. Hence, when production parts are assembled into the slot environment, small radial and circumferential clearances occur between the parts which permit the aforementioned movement.

SUMMARY OF THE INVENTION

It is therefore an object of the present invention to provide an improved blade locking device which provides for positive retention of a blade in a predetermined axial and radial position relative to the rotor.

It is a further object of the present invention to provide such a blade locking device which is easily removable from one side of the rotor and is reusable in the event the blade must be removed during routine maintenance.

It is still another object of the present invention to provide a blade locking device wherein substantial available slot width is utilized to permit the use of retaining members with increased cross-sectional area.

It is still yet another object of the present invention to provide a blade locking device which biases the blade against minor radial and angular movement due to clearances between the blade tang, locking device and the rotor slot.

It is a further object of this invention to provide for a method of locking a blade in a fixed axial and radial position relative to a rotor in an efficient and convenient manner.

These and other objectives which will become apparent hereinafter are accomplished by the present invention which provides a blade locking device for locking radially projecting blades on a rotor, each blade having a dovetail tang at its radially inward end including a forward end face and an aft end face and the rotor having dovetail slots extending across its periphery from one side of the rotor to the other with outwardly facing abutment surfaces on each side of the rotor proximate said dovetail slot, each dovetail tang being received in one of the slots with a radial space between the tang and the bottom of the slot. The locking device is comprised of retaining members residing in the radial space and each having enlarged end portions protruding from the slot, said end portions providing inwardly facing abutment surfaces. The retaining members are circumferentially spaced from one another by spacer means which serve to maintain the inwardly facing abutment surfaces on the retaining pins in confronting and overlapping relationship with the outwardly facing abutment surfaces on the rotor and said end faces. The spacer means is held from axial movement relative to said retaining member.

DESCRIPTION OF THE DRAWINGS

The above and other related objects and features of the present invention will be apparent from a reading of the following description in conjunction with the accompanying drawings wherein.

DETAILED DESCRIPTION

Figures 1, 2, 3, 4:
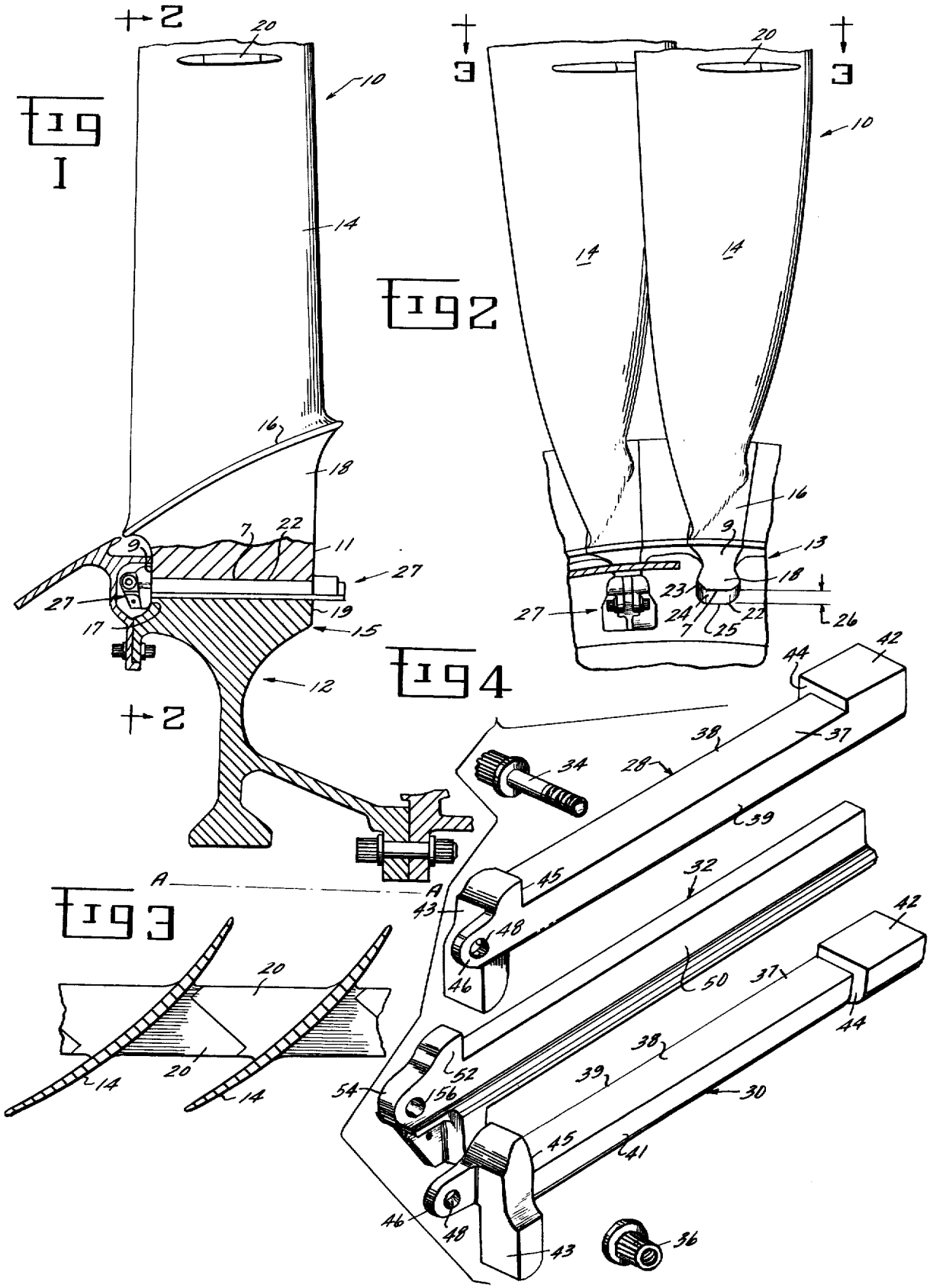
FIG. 1 is a radial cross-sectional view of a blade and rotor combination to which the present invention has been applied.
FIG. 2 is an axial view along line 2—2 of FIG. 1 of a rotor stage incorporating blade locking means according to the present invention.
FIG. 3 is a view along line 3—3 of FIG. 2 disclosing the integral shroud structure of the blades.
FIG. 4 is an exploded perspective view of the retaining pins and the spacer member of the present invention.

Referring now to FIG. 1 of the drawings, a rotor blade shown generally at 10 is depicted in combination with a rotor disc shown generally at 12, both of which during operation rotate about an axis shown generally by line A—A. Rotor blade 10, having a large radial dimension, is comprised of an airfoil 14, a platform 16 and a radially inwardly extending tang 18 comprised of radially inwardly facing suface 7 and forward and aft end faces 9 and 11, respectively. Shroud segment 20 cooperates with similar shroud segments of adjacent blades approximately at mid span of rotor blade 10 to render stability to blade 10, which otherwise would exhibit excessive deflection under operating conditions due to its large radial dimension and relatively small thickness.

Referring now to FIGS. 1 and 2, the rotor 12, having forward and aft facing sides shown generally at 13 and 15 respectively, includes a plurality of dovetail slots 22 (one of which is shown without a retaining member) each adapted to receive the tang 18 of blade 10 in a retaining relationship. The rotor slots 22 extend across the periphery of the rotor 12 from forward side 13 to aft side 15 and are of such a depth that, upon receiving the tang 18 of blade 10, there is defined a space 24 having a predetermined radial height 26. Proximate the forward and aft end of slot 22, outwardly facing abutment surfaces 17 and 19 are provided on rotor sides 13 and 15 respectively. Space 24 serves the function of permitting individual blades to be moved radially inwardly with respect to the rotor prior to removal from the slot 22 in order to disengage the shroud segments 20 from contact with one another. FIG. 3 depicts a top view of adjoining blades disclosing the cooperation of mating segments of the mid span shrouds 20. In order to withdraw a blade axially it is first necessary to remove the associated segment 20 from its interlocking relationship with similar segments. Slot 22 is of generally U-shaped cross-sectional configuration with walls 23 forming the legs of the U and bottom wall 25 of the slot forming base of the U.

Rotors of the variety described above generally rotate with extremely high velocities. As a result, in absence of effective means for maintaining axial blade position, the reaction of the airfoils to foreign object impingement, blade tip rub, blade vibration or reaction to the air accelerated therethrough would tend to drive the blades 10 out of slots 22. If such were to occur, extensive damage could be done to the associated engine and its surroundings. As a result it has become necessary to devise effective and reliable means for maintaining the blades 10 in a fixed relationship with the rotor 12. The present invention accomplishes this by means of utilizing the space 24 and placing therein a locking device generally indicated at 27 that fixedly retains blade tang 18 within slot 22 in an accessible and releasable manner.

Figure 5:
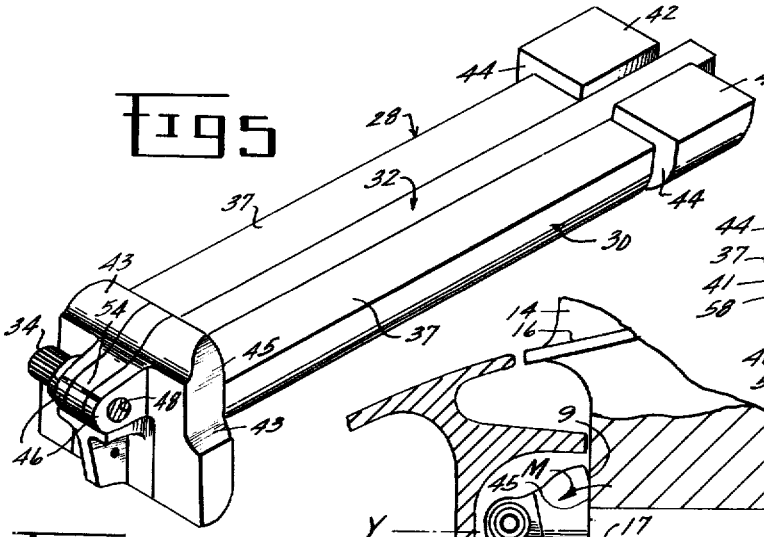
FIG. 5 is a perspective view of the retaining pins and the spacer member of the present invention in cooperative engagement.

Referring now to FIGS. 4 and 5, the locking device 27 is comprised of axially extending retaining members shown generally at 28 and 30, axially extending spacer member shown generally at 32 and bolt 34 and nut 36. Retaining members 28 and 30 are mirror images of each other and have central elongated stem segments 37 of reduced cross section intermediate enlarged aft end portions or lugs 42 and forward end portions or lugs 43 at each end thereof. Forward end lugs 43, extend substantially in a radially outwardly and radially inwardly direction. The axial length of stem segments 37 is substantially equal to the axial length of slot 22. Each stem segment 37 has a radially outwardly facing bearing surface 38, a circumferentially inwardly facing side 39, a radially inwardly facing bearing surface 40 (FIG. 7) and a circumferentially outwardly facing side 41. Each aft end lug 42 is constructed to pass through space 24 while each forward end lug 43 is of a radial length greater than height 26. Hence, improper installation of the locking device in slot 22 is avoided. End lugs 42 and 43 cooperate with stem 37 to form inwardly facing abutment faces 44 and 45 respectively which extend in a radial and circumferential direction. The axial distance between abutment faces 44 and 45 substantially equals the axial length of slot 22. Appendages 46, having apertures 48 extending therethrough, axially protrude from enlarged forward end lugs 43 of retaining members 28 and 30.

Spacer members 32, adapted to fit between retaining members 28 and 30, has an axial extending elongated central portion 50 with lug 52 integrally formed at the forward end thereof. Appendage 54, having an aperture 56 extending therethrough, axially protrudes from lug 52. As shown in FIG. 5, retaining members 28 and 30 are spaced from one another by spacer member 32 which is held from relative axial movement therewith by bolt 34 inserted through apertures 48 and 56.

Figure 7:
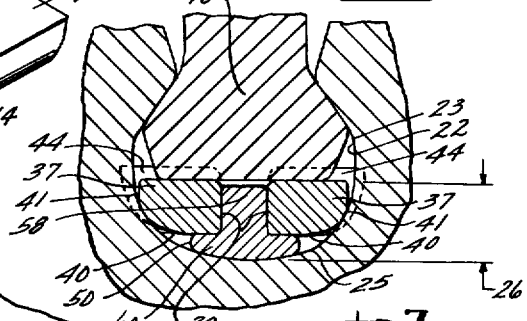
FIG. 7 is a cross-sectional view along line 7—7 of FIG. 6 disclosing the blade locking device in cooperation with the blade tang and rotor slot.
Figure 6:
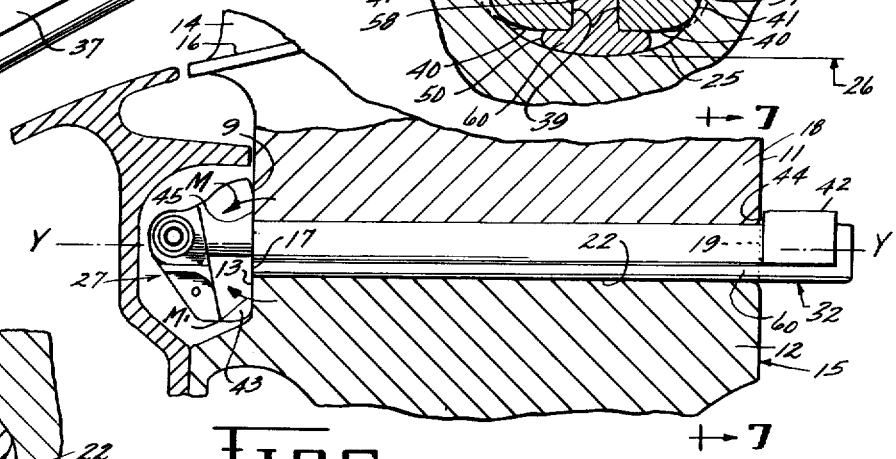
FIG. 6 is an enlarged view of the locking device, rotor slot and blade tang shown in the radial cross-sectional view of FIG. 1.

Referring now to FIGS. 6 and 7, the locking device 27 is shown in its installed position cooperating with rotor slot 22 and blade tang 18. As can best be observed from FIG. 7, central portion 50 of spacer member 32 is of an inverted T-shaped cross section with a leg 58 integrally formed with and radially extending from a base 60. Leg 58 is positioned between and in engagement with side 39 of each retainer 28 and 30 thereby serving to space retainers 28 and 30 circumferentially from each other and effecting engagement of sides 41 of retainers 28 and 30 with the walls 23 of slot 22. Base 60 is positioned radially inwardly of stem portions 37 and engages bearing surface 40 of both stem portions 37 and the bottom wall 25 of slot 22 thereby holding retainers 28 and 30 and blade tang 18 in a generally fixed radial position with respect to rotor disc 12.

With locking device 27 in the installed position, abutment surfaces 44 of aft lugs 42 are in confronting and overlapping relationship with outwardly facing abutment surface 19 on the aft side 15 of rotor 12 and with aft end face 11 of blade tang 18. Similarly at the other end of slot 22, abutment surfaces 45 of forward lugs 43 are in confronting and overlapping relationship with outwardly facing abutment surface 17 on the forward face 13 of the rotor 12 and with forward face 9 of blade tang 18. More specifically, if any forces were applied to blade 10 tending to displace it from slot 22 in a forward direction, the overlap of abutment surface 45 on forward lug 43 and the forward end face 9 of tang 18 would prevent forward movement of blade 10. Forward movement of retainers 28 and 30 is prevented by overlap of abutment surfaces 44 of aft lugs 42 and abutment surface 19 on the aft side 15 of rotor 12. On the other hand, if any forces were applied to blade 10 tending to displace it from slot 22 in an aft direction the overlap of abutment surfaces 44 of aft lugs 42 and the aft end face 11 of blade tang 18 would prevent aft movement of blade 10. Aft movement of retainers 28 and 30 is prevented by overlap of abutment surfaces 45 of forward lugs 43 and abutment surface 17 on the forward side 13 of rotor 12. In this manner with spacer 32 inserted blade 10 is securely locked within slot 22 of rotor 12 and is fixed against relative axial movement with respect to rotor 12.

Figure 8:
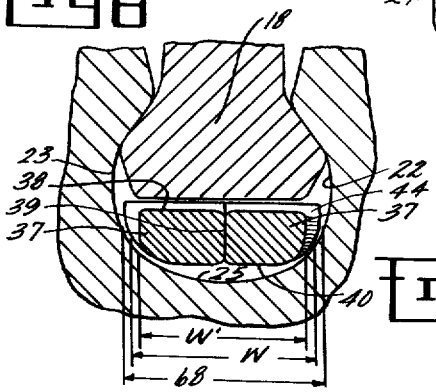
FIG. 8 is a cross-sectional view showing the blade retaining pins during insertion into the rotor slot.

Referring to FIG. 8 retaining members 28 and 30 are shown positioned during insertion into slot 22 in accordance with one method of the present invention wherein both retaining members are inserted simultaneously. Aft lugs 42 are generally constructed such that they will freely pass through space 24 when retainers 28 and 30 are positioned such that side 39 of retainer 28 engages side 39 of retainer 30. More specifically the combined circumferential width 68 of both aft lugs 42 is less than the width of slot 22 at the corresponding radial distance from the axis of rotation of rotor disc 12. Furthermore, the combined circumferential width W of both aft lugs 42 at any radial distance from the axis of rotation of disc 12 is less than the width of slot 22 at the same radial distance.

An alternate method of inserting retaining members 28 and 30 into slot 22 can be utilized to achieve greater bearing area of abutment surfaces 44. In this alternate method the combined circumferential width W of both aft lugs 42 may be increased such that width W is greater than the width of slot 22 at the same radial distance. In the event retainers 28 and 30 are so designed they must be inserted sequentially into slot 22; that is one after the other. More specifically, retainer 28 is inserted into slot 22 until aft lug 42 protrudes from the aft end thereof and the retainer 28 is moved circumferentially and radially outward such that outwardly facing side 41 of stem 37 engages wall 23 of slot 22. Next retainer 30 is inserted into slot 22 until aft lug 42 protrudes from the aft end thereof and then retainer 30 is moved circumferentially and radially outward until its outwardly facing side 41 engages wall 23 of slot 22. Hence the aft lugs 42 positioned as described can be inserted into and through slot 22 by either of the two alternative methods described herein.

When retaining members 28 and 30 are inserted simultaneously into slot 22, the combined circumferential width W of both aft lugs 42 at any given radial distance from the axis of rotation is of course limited by the width of slot 22 at the same radial distance. The combined circumferential width W' of both stems 37 are designed such that they substantially fill the width of slot 22 except for a small clearance between outwardly facing sides 41 and walls 23 of slot 22. This clearance, which may vary in the radial direction, is necessary since stems 37 must be moved circumferentially apart from each other and into engagement with walls 23 to effect placement of abutment surfaces 44 in confronting and overlapping relationship with abutment surfaces 19 on the aft side 15 of rotor 12. Since this overlap is minimal when compared to the entire width of slot 22, stems 37 substantially fill the width of slot 22 and hence optimum load-bearing capacity of retainers 28 and 30 is achieved. After stems 37 are moved circumferentially outward to engage surfaces 41 with the walls 23 a gap is produced between inwardly facing surfaces 39 of stems 37. The circumferential width of this gap is equal to the sum of the distances which each stem 37 is moved circumferentially outward. Spacer 32, which is inserted into the gap, has a circumferential width equal to the width of the gap and hence equal to the sum of the distance each stem 37 is moved circumferentially. Hence the width of spacer 32 is also minimal when compared to the overall width of the slot 22.

In the alternate method of insertion of retaining members 28 and 30 into slot 22 sequentially as described above, one stem 37 of one of the retaining members 28, 30 will be disposed within slot 22 while lug 42 of the other of the retaining members 28, 30 is inserted through the slot 22. In order to pass lug 42 of one retaining member through slot 22 while the stem 37 of the other retaining member resides therein, the retaining members 28 and 30 are constructed such that the combined circumferential width of one of the stems 37 and one of the lugs 42 is not greater than the width of the slot 22 at the same radial distance from the axis of rotation of rotor 12. As in the previously described method of simultaneous insertion, a circumferential gap is produced between retainers 28 and 30 after they have been inserted into slot 22 and moved circumferentially apart. Spacer member 32 is inserted into the gap. The sequential method of insertion of retaining members 28 and 30 is generally preferred over the simultaneous method in instances where increased bearing area is desired on abutment surfaces 44 which can be accomplished without reducing the circumferential width of the stems 37. It is readily apparent that, with either method of insertion, the present invention provides a locking device wherein the retaining members are designed to utilize available slot width to effect optimum load-bearing capacity.

Assembly of the blade 10, rotor 12 and locking device 27 will now be described. Generallly, assembly is accomplished by sliding tang 18 of blade 10 into rotor slot 22 and thereafter inserting the locking device 27. More specifically, after tang 18 is inserted into slot 22 it is raised radially outwardly until the tang 18 engages mating portions of slot 22 thereby interlocking shroud segments 20 with shroud segments of adjacent blades. In order to maintain the blade 10 in this position the locking device 27 of the present invention is inserted.

First, retaining members 28 and 30 are inserted into slot 22 such that aft end lugs 42 protrude from the aft end of slot 22 and the forward lugs 42 are immediately adjacent the forward end of slot 22. As previously described insertion can be accomplished simultaneously or sequentially but in either instance retaining members 28 and 30 eventually are moved radially and circumferentially outward such that their upper surfaces 38 engage the radially inwardly facing surface 7 on blade tang 18 and such that their circumferentially outwardly facing surfaces 41 engage the side walls 23 of slot 22. Such movement leaves a gap between inwardly facing surfaces 39 of stems 37. Such circumferentail and radial movement also places aft lug abutment surfaces 44 in confronting and abutting relationship with outwardly facing abutment surface 19 on the aft side 15 of rotor 12 and with aft end face 11 of blade tang 18. With the retainers 28 and 30 in this position spacer member 32 is next inserted into slot 22 such that its leg 58 resides in the aforesaid gap and engages inwardly facing surfaces 39 of stems 37 of retainers 28 and 30. Base 60 is disposed between and engages the lower radially inwardly facing surfaces 40 of retainers 28 and 30 and bottom wall 25 of slot 22. With spacer 32 in this position retainers 28 and 30 are held from radial, circumferential and axial movement relative to blade tang 18 and slot 22 of rotor 12. In order to keep spacer member 32 from emerging from slot 22, it is fixed to retainers 28 and 30 by the insertion of bolt 34 through apertures 48 and 56. Bolt 34 is fixedly held in position by the threading of nut 36 on the end thereof.

With the locking device 27 assembled in this manner, any forces applied to blade 10 tending to displace blade 10 from slot 22 will be resisted by retaining members 28 and 30. More specifically, blade 10 is prevented from axial forward and aft movement by forward lugs 43 and aft lugs 42 respectively of retainers 28 and 30. Since it is the normal tendency for the blade 10 to move the forward direction, forward lugs 43 have been designed such that abutment surfaces 45 provide further protection from retainer failure and blade emergence. Forces applied by the blade 10 to the retaining members 28 and 30 produce not only a tensile stress due to the axial nature of such forces but also a bending moment due to the fact that such forces are applied above axial centerline Y—Y and hence over a moment arm with respect to the retainers 28 and 30. The tensile loads due to the axial nature of such forces have been addressed by utilizing optimum cross-sectional area of the load-carrying members (retainers 28 and 30) within the geometric limits of slot 22 as previously described herein. The stresses introduced by the bending moment have been addressed by providing lugs 43 with means for reacting the bending moment. More specifically, looking at FIG. 6, a bending moment M in a counter-clockwise direction produced by tang 18 exerting a force upon lugs 43 at a point or points above the axial centerline Y—Y of retainers 28 and 30 are reacted by reactive moment M' in a clockwise direction produced by engagement of abutment surfaces 45 which extend substantially in a radially inward direction with abutment surface 17 on the forward face 13 of rotor 12 at a point or points below the axial centerline Y—Y of retainers 28 and 30. Hence retainers 28 and 30 are subjected to very little, if any, deformation due to bending stress.

In the fabrication of turbomachinery it is normal practice to machine associated parts to within generally accepted tolerances. In the present instance, the machining of the rotor tang 18, the rotor slot 22 and the locking device to within generally accepted tolerances may result in a slightly loose fit between these associated parts with the result that rotor blade 10 may exhibit slight radial and angular movement. While such movement is normally minimal it can result in appreciable audible noise as the rotor blade intermittently strikes against other component parts in its slot environment and at the shroud segments 20 interlock. This undesirable condition is addressed by another aspect of this invention which will now be described in detail with reference to FIGS. 9, 10 and 11. The embodiment shown therein exhibits a modified construction of spacer member 32 and, for the sake of consistency, elements identical to those described in the previous embodiment will bear corresponding numerical designations.

Figure 9:
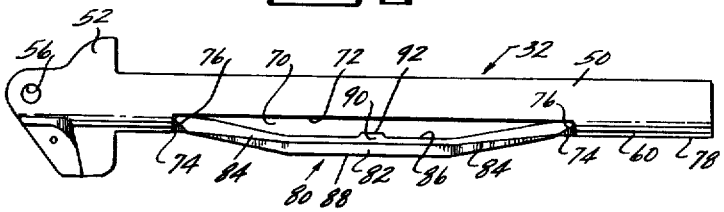
FIG. 9 is a side view of a modified and alternate embodiment of the spacer member of the present invention.

As best observed in FIG. 9, central portion 50 of spacer member 32 has been modified to incorporate an elongated recess 70 formed in base 60 of spacer 32. Recess 70 is comprised of an axial extending upper wall 72 terminating at forward and aft ends into axially inwardly projecting keeper tabs 74 having inwardly sloping surfaces 76 which are constructed such that the axial length of recess 70 is greater at the juncture of wall 72 and sloping surfaces 76 than at the juncture of sloping surface 76 and the bottom 78 of base 60.

Biasing wedge 80, comprised of a resilient material capable of elastic deformation, is inserted into recess 70 in a manner hereinafter to be described. Biasing wedge 80 is comprised of a central segment 82 interposed intermediate two end segments 84, and in its free position (that is in a position in which it is not associated with recess 70), has an overall axial length slightly greater than the axial length of recess 70. Central segment 82 and end segments 84 are formed such that biasing wedge 80 has a generally arcuate shape with a concave side 86 facing toward wall 72 and convex side 88 facing away from wall 72. A raised platform 90 having an abutment surface 92 is located on the concave side 86 of biasing wedge 80 adjacent central segment 82.

Figure 11:
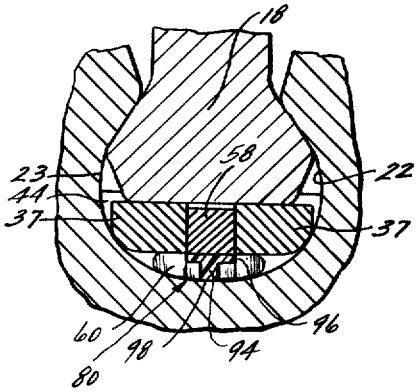
FIG. 11 is a cross-sectional view along line 11—11 of FIG. 10 of the blade locking device incorporating the modified spacer member in cooperation with the blade tang and rotor slot.

As best observed in FIG. 11, biasing wedge 80 has a T-shaped cross section with leg 94 extending radially inward from a base portion 96. The radial height of leg 94 and the radial height of base 96 each are of constant magnitude across the axial length of central segment 82. On the other hand, the radial height of leg 94 decreases and the radial height of base 96 increases as either end segment 84 is traversed axially outwardly from central segment 82. However, the combined radial height of leg 94 and base 96 is substantially equal across the entire axial length of biasing wedge 80. Leg 94 terminates into surface 98 which partially defines the convex side 88 of biasing wedge 80. Finally the radial distance between surface 92 of platform 90 and surface 98 of leg 94 is of a carefully predetermined selected magnitude.

The installation and operation of the biasing wedge will now be described. Since the axial length of biasing wedge 80 is slightly greater than the axial length of recess 70, insertion of wedge 80 into recess 70 is accomplished by deflecting ends segments 84 arcuately and inwardly toward each other and then inserting wedge 80 into recess 70 such that keeper tabs 74 overlap a portion of end segments 84. In this position, wedge 80, which is constructed of a resilient material, is contained within the recess 70 by tabs 74 and by the internal restoring forces in wedge 80 resulting from deformation from its free position. Hence, wedge 80 is pre-assembled into recess 70 and the internal forces of wedge 80 due to deformation of end segments 84 from their free position maintains wedge 80 and spacer member 32 in cooperating engagement.

Figure 10:
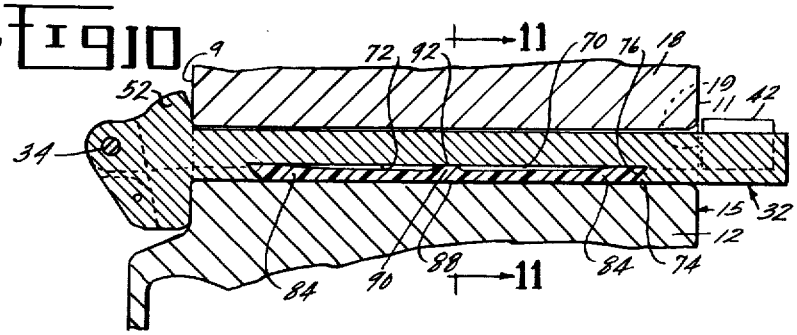
FIG. 10 is a cross-sectional view of the rotor slot and blade tang and the modified spacer shown in FIG. 9.

After inserting and positioning retaining members 28 and 30 into slot 22 as previously set forth herein spacer member 32 and wedge 80 are then inserted into slot 22 with spacer member 32 engaging and cooperating with retaining members 28 and 30 in the same manner as set forth in the description of the previous embodiment of this invention. With spacer 32 and biasing wedge 80 positioned in slot 22 as shown in FIGS. 10 and 11, abutment surface 92 of platform 90 is in abutting engagement with wall 72 of recess 70 and surface 98 of leg 94 is in abutting engagement with wall 25 of slot 22. Furthermore, the normal radial distance between abutment surface 92 of platform 90 and surface 98 is greater than the distance between wall 72 of recess 70 and bottom wall 25 of slot 22 such that platform 90 and the adjacent portion of central segment 82 are compressed between wall 72 of spacer 32 and the bottom wall 25 of slot 22. The elastic compression force in biasing wedge 80 resulting therefrom biases spacer element 32, retainers 28 and 30 and rotor blade 10 in a radial outwardly direction. Hence, rotor blade 10 is prevented from moving radially or angularly within slot 22. Without the use of biasing wedge 80 such movement could result from normal tolerances in the fabrication of the rotor blade 10, the slot 22 and the locking device 27.

While the distance between wall 72 of spacer member 32 and wall 25 of rotor slot 22 may vary between a maximum magnitude and a minimum magnitude depending upon the actual machined dimensions of rotor slot 22, rotor blade 10 and locking device 27, the radial distance between surface 92 of platform 90 and surface 98 of leg 94 can be designed with a predetermined magnitude such that platform 90 and the adjacent central segment 82 are compressed for all possible combinations of machined dimensions. In order to increase or control more accurately the compressive force effectively available across the range of tolerance stack-up the radial distance between surface 92 and surface 98 can be designed with an increased predetermined magnitude such that, for minimum distances between wall 72 and wall 25 a portion of leg 94 is shaved or sheared away at the forward end of slot 22 during insertion of spacer member 32 and biasing wedge 80 into slot 22. By careful selection of the radial distance between surface 92 and surface 98, a preselected range of compressive biasing forces can be insured for all combinations of machined dimensions of rotor blade 10, slot 22 and locking device 27.

From the foregoing it is now apparent that a locking device arrangement has been provided which is well adapted to fulfill the aforestated objects of the invention and that while only a number of embodiments of the invention have been described for purposes of illustration, it will be apparent that other equivalent forms of the invention are possible within the scope of the appended claims.

Having thus described the invention, what is claimed as new and useful and desired to be secured by U.S. Letters Patent is:

1. A blade locking device for locking radially projecting blades in a rotor, each blade having a dovetail tang at its radially inward end including a forward end face and an aft end face and the rotor having dovetail slots extending across its periphery from one side of the rotor to the other with outwardly facing abutment surfaces on each side of said rotor proximate said dovetail slot, each dovetail tang being received in one of said slots providing a radial space between the tang and the bottom of the slot, said device comprising:

a pair of retaining members in a first position residing in and extending through said radial space, one circumferentially spaced from the other, each having enlarged forward end and aft end portions which protrude from said slot, each of said enlarged end portions providing inwardly facing abutment surfaces;

spacer means disposed between said retaining members for maintaining said retaining members circumferentially spaced from each other and for maintaining said inwardly facing abutment surfaces in confronting and overlapping relationship with said outwardly facing abutment surfaces; and means for preventing relative axial movement between said spacer means and said retaining members.

2. The locking device as set forth in claim 1 wherein said circumferential spacing is of a first predetermined magnitude when said retaining members are in said first position in said radial space, said retaining members being movable to said first position from a second position in said radial space wherein the magnitude of said circumferential spacing is of a magnitude less than said first magnitude.

3. The locking device as set forth in claim 2 wherein the magnitude of said circumferential spacing when said retaining members are in said second position is zero.

4. The locking device as set forth in claim 2 wherein said retaining members are in said second position when at least one of said aft end lugs is disposed within said radial space.

5. The locking device as set forth in claim 1 wherein the spacer means further maintains said inwardly facing abutment means in confronting and overlapping relationship with said outwardly facing end faces.

6. The locking device as set forth in claim 5 wherein said spacer means is comprised of a base portion and a leg extending radially outward from said base portion, said leg being disposed between said retaining members and said base being disposed between said retaining members and the bottom of the rotor slot.

7. The locking device as set forth in claim 1 wherein said means for preventing axial movement comprises fastening means fixedly connecting said spacer means to at least one of said retaining members.

8. The locking device as set forth in claim 1 further comprising biasing means for resiliently biasing said rotor blade in a radially outwardly direction.

9. The locking device as set forth in claim 8 wherein said biasing means comprises a resilient biasing member disposed between said blade tang and the bottom of said rotor slot.

10. The locking device as set forth in claim 9 further comprising a recess in said spacer means said biasing member being located in said recess and keeper means for retaining said biasing means in said recess.

11. The locking device as set forth in claim 1 wherein said forward end portions comprise means for resisting bending moments applied to said forward end portions by said blade tang.

12. A method for locking a rotor blade, having a dovetail tang as its radially innermost end with a forward end and an aft end face on said tang at the axial ends thereof, on a rotor disc, having a dovetail slot extending across its periphery from one side of the rotor to the other with a pair of outwardly facing abutment surfaces on each side of said rotor proximate the dovetail slot, comprising:

inserting said dovetail tang into said dovetail slot to provide a radial space between the dovetail tang and a bottom wall of the dovetail slot;

inserting a pair of retaining members having enlarged forward and aft end portions into said radial space such that each of said portions protrude from said slot at the forward and aft end thereof respectively;

moving said retaining members circumferentially with respect to one another to form a gap therebetween such that said end portions overlap and confront said outwardly facing abutment surfaces;

inserting a spacer member into said gap to maintain said retaining members circumferentially spaced apart and to maintain said end portions in overlapping and confronting relationship with said outwardly facing abutment surfaces; and locking said spacer member from axial movement relative to said retaining members.

* * * * *